United States Patent [19]

Tabet

[11] 4,349,857

[45] Sep. 14, 1982

[54] LIGHT RESPONSIVE CONTROL DEVICE

[75] Inventor: Michael A. Tabet, Norfolk, Va.

[73] Assignee: Tabet Manufacturing Company, Norfolk, Va.

[21] Appl. No.: 874,759

[22] Filed: Feb. 3, 1978

[51] Int. Cl.[3] ..... H01H 47/24

[52] U.S. Cl. ..... 361/173; 250/239

[58] Field of Search ..... 361/173; 307/117; 250/214 AL, 206, 239; 335/257, 277, 248, 131, 261

[56] References Cited

U.S. PATENT DOCUMENTS

| | | | |
|---|---|---|---|
| 725,523 | 4/1903 | Wellman | 335/261 |
| 2,531,025 | 11/1950 | Bradley | 335/131 |
| 2,877,390 | 3/1959 | Trombetta | 335/257 |
| 2,898,525 | 8/1959 | Jacobs | 361/173 X |
| 2,978,591 | 4/1961 | Ringger | 250/239 |
| 3,048,833 | 8/1962 | Bernheim | 250/206 |
| 3,401,311 | 9/1968 | Burch | 361/173 |

*Primary Examiner*—J. D. Miller
*Assistant Examiner*—L. C. Schroeder
*Attorney, Agent, or Firm*—Stevens, Davis, Miller & Mosher

[57] ABSTRACT

A light responsive control device comprising a light sensitive element, having a resistance which corresponds to the amount of light incident thereon, and an electromagnet having its coil connected in series with the light sensitive element. An armature is operated by the electromagnet so that it engages a contact member positioned below the armature when the electromagnet is deenergized and is separated therefrom when the electromagnet is energized. A non-magnetic element is secured to a surface of the armature to assure prompt release of the armature when the electromagnet is deenergized and a non-magnetic guide pin attached to the non-magnetic element extends into an aperture in the electromagnet to guide the movement of the armature. When the ambient light impinging on the light sensitive element is low, its resistance is high and a load connected between the armature and contact member is energized. An increase in the ambient light above a predetermined level causes the resistance of the light sensitive element to decrease thereby energizing the electromagnet and opening the load circuit. The pick-up and drop-out of the relay occurs within a narrow range surrounding a nominal predetermined value.

7 Claims, 8 Drawing Figures

LIGHT RESPONSIVE CONTROL DEVICE

BACKGROUND OF THE INVENTION

Control devices which respond to ambient light conditions have been extensively employed for turning on and off street and highway lamps as well as lighting for other public facilities. These devices generally utilize a light sensitive element which has a low electrical resistance when illuminated and a relatively high resistance when it is in the dark.

In a typical prior device, a photocell is connected in series with a lighting load, a power source and either an electromagnetically actuated relay of the type having a hinged armature and normally closed contacts or a thermally actuated relay having normally closed contacts. When the cell is in the dark, its resistance is high and the current flowing through the relay coil is too low to open the relay contacts. Since the contacts in series with the load are closed when the relay is deenergized, current flows through the lighting load. When the light impinges on the cell, its resistance decreases causing current to flow through the relay coil thereby opening the relay contacts and disconnecting the load. These devices are constructed so that they are fail safe; that is, the lighting load is energized in the event the photocell or relay should fail. They may be used to control one or a plurality of street lamps and generally consume little power. Examples of such control switches are disclosed in my U.S. Pat. Nos. 3,250,951 granted May 10, 1966 and 3,093,744 granted June 11, 1963.

A disadvantage encountered with these prior art devices is that they are extremely difficult to adjust so that the lighting load will be turned on and off at a precise predetermined level of ambient illumination. This is primarily because the spring tension on the relay contacts is variable and difficult to set. In a typical control switch, the relay will drop out for values of illumination which are much less than those required to pick up the relay, the ratio of drop-out to pick-up sometimes being as high as 4.0. Consequently, the street lamp may be turned on and off at levels of ambient illumination other than the desired one and, in lighting systems in which each lamp is controlled by an individual switch, the lights may turn on and off in an erratic pattern.

Until recently, the inability to accurately control the operation of such switches has not been an economically important factor because of the relatively low cost of electrical energy. However, as the cost of generating and transmitting electrical energy has increased, it has become of greater importance that lamps used for public lighting be turned off as soon as the ambient light has reached a predetermined value at which they are not longer needed, and that the lamps not be turned on again until the ambient level has fallen to the same value. As an example, it would be desirable to have a control switch which would both open and close at an ambient illumination of approximately one footcandle with the ratio of drop-out to pick-up being as close to unity as possible.

Accordingly, it is an object of my invention to provide a light responsive control device which can energize or deenergize a load when the incident illumination is within a narrow predetermined range.

Another object is to provide a control device wherein the pick-up and drop-out characteristics are substantially identical from unit to unit and which does not require adjustment in the field.

Other objects are to provide a control device which is fail safe in operation, has a simple and compact construction, is easy to install, will operate for many years and is relatively inexpensive.

SUMMARY OF THE INVENTION

This invention relates to a light responsive control device and, in particular, to a switch for controlling a load in response to a predetermined value of light incident thereon. It consists of a light sensitive element or photocell connected in series with the coil of an electromagnet, the electromagnet being mounted with its longitudinal axis in the vertical direction. A magnetic armature is positioned below the electromagnet so that, when the magnet is deenergized, the armature drops by gravity toward a contact plate located below it. The armature and contact plate are connected through terminals to a lighting load and a source of voltage and, therefore, when the electromagnet is deenergized the circuit to the lighting load is completed through the armature and contact plate. When the electromagnet is energized, the circuit is broken.

The armature is composed of a disc made of magnetic material having a non-magnetic element secured to its upper surface. Attached to the center of the non-magnetic element is a non-magnetic guide pin which moves slidably within an aperture extending along the longitudinal axis of the electromagnet. By using a non-magnetic guide pin and a non-magnetic element secured to the magnetic armature disc, it is possible to lift the armature in response to the precise level of illumination impinging on the photocell thereby breaking the contact with the contact plate. Conversely, the electromagnet will be deenergized causing the armature to drop toward the contact plate at a level of ambient illumination impinging on the photocell which is quite close to the same predetermined light level.

The invention will be more clearly understood from the following description and accompanying drawings which relate to a particular embodiment.

DESCRIPTION OF THE PREFERRED EMBODIMENT

Figure 1:
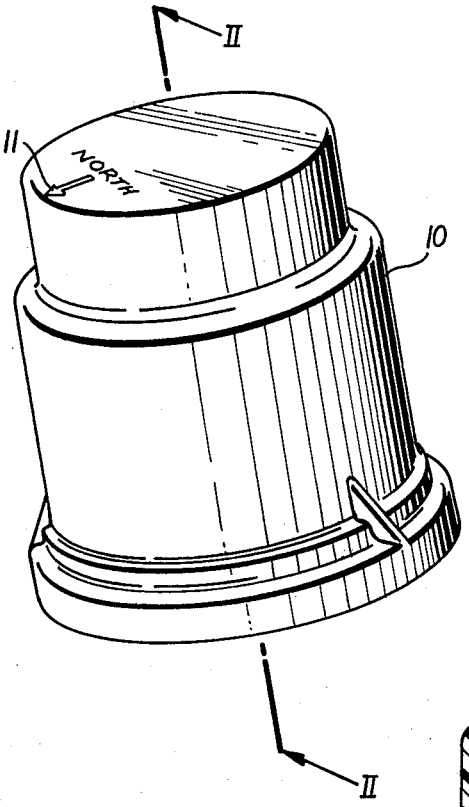
FIG. 1 is an external perspective view of the light responsive control device of this invention.
Figure 2:
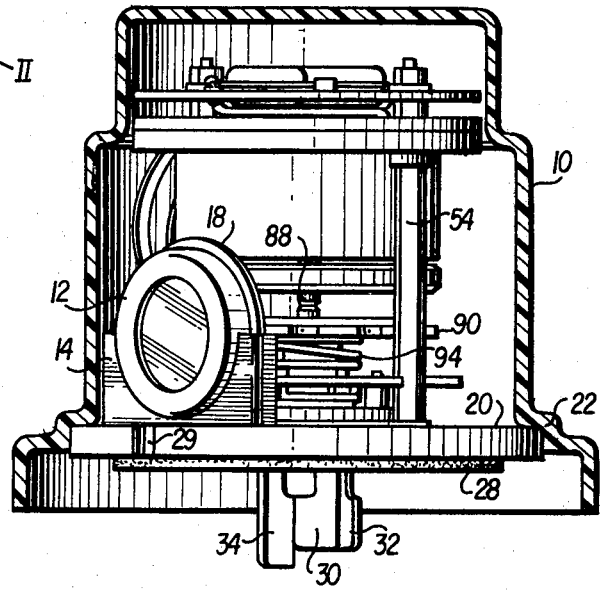
FIG. 2 is a cross-sectional view of the control device taken along the lines II—II.

Referring to the perspective view of FIG. 1 and the cross-sectional view of FIG. 2, the light responsive control device is encased in a transluscent housing 10 made of an acrylic material such as Lucite having a light transmission of between 10 and 40 percent which surrounds and protects the device components while permitting light to impinge on a light sensitive element or photocell 12. The photocell may, for example, be a type 7163 photoconductive cell manufactured by the Radio Corporation of America. The entire control device is oriented so that the photocell 12 receives unobstructed light from the northern sky (when it is used in the northern hemisphere), this orientation offering the most consistent light at twilight and avoiding direct sun rays on the cell 12. In a typical application, the device is located at the top of a luminaire so that it will be shielded from sources of artificial light such as the head lamps of automobiles, signs and other artificial illumination.

As shown in FIGS. 2–5, the photocell 12 is mounted on a support element 14 having a groove 16 therein for receiving a flange 18 of the photocell. Support element 14 is mounted on a base member 20 in the form of a disc made of insulating material which fits within a flange 22 of the housing 10 and is secured thereto by screws which are inserted in holes 26 of base 20. A gasket 28 is cemented to the bottom of base 20 to provide a seal when the control device is inserted into a standard socket base (not shown) and a notch 29 in base 20 receives a projection (not shown) on housing 10 to assure that the arrow 11 on housing 10 is aligned with photocell 12. Projecting from the bottom of base 20 are prongs 30, 32 and 34 which connect to a voltage source 31 and lighting load 33 through the socket base, as will be described hereinafter in connection with the schematic electrical diagram of FIG. 8.

Prong 30 passes through a slot 36 in base 20 and is fastened by a screw 37*a* and nut 37*b* to a conductive strip 38 having a V-shaped slot 40 in an L-shaped portion thereof to which terminal 42 of photocell 12 is soldered. Prong 32 extends through a slot 44 in base 20 and is attached to a conductive strip 46 by a screw 45*a* and nut 45*b*. Strip 46 has a hole 43 to permit a threaded end 47 of an electrically conductive post 48 to be secured into base 20. Thus, prong 32 is electrically connected through conductive strip 46 to post 48.

The other terminal 50 of photocell 12 is soldered to a V-shaped slotted portion 51 of a conductive strip 52 secured to base 20 by an electrically conductive post 54 having a threaded end 56 which is screwed into base 20 through a hole 53 in strip 52.

An insulating disc 58, having a rectangular aperture 60 and circular apertures 62 and 64 therein is positioned relative to base 20 by projections 66 and 68 respectively which project from the base 20.

A metallic stud 70 having a threaded lower portion 72 is screwed into an insulating collar 74 on base member 20 after passing through a central aperture 76 in disc 58. Stud 70 is further provided with an upper threaded portion 78 having a greater diameter than lower threaded portion 72. A conductive disc 80 having an L-shaped member 82 secured to one edge thereof is interposed between an hexagonal portion 84 of stud 70 and insulating disc 58. Disc 80 is fastened to prong 34, which passes through a slot 35 in base 20, by a screw 39*a* and nut 39*b*. It provides a conductive path between prong 34 and metallic stud 70.

A contact plate 86 having a centrally located cylindrical contact 88 on the upper surface thereof is attached to an insulating adusting ring 90 having U-shaped cut-outs around its edges to facilitate rotation thereof. The lower side of contact plate 86 is provided with an internally threaded conductive member 92 which mates with the threaded portion 78 on metallic stud 70. Rotation of ring 90 causes the contact plate 86 to be displaced vertically as member 92 rotates on threaded portion 78. A helical spring 94 surrounds stud 70 and presses against member 92 and disc 58 thereby preventing unwanted rotation of the contact plate 86.

An electromagnet 96 having a cylindrical coil 97 wound thereon is mounted on the upper ends of conducting posts 48 and 54 and insulated therefrom by means of bushings 98 and 100 which are inserted in holes in a disc 101. Electromagnet 96 is provided with a centrally located aperture 102 on the bottom part thereof and operates in conjunction with an armature 104 comprising an armature disc 106 of magnetic material, an armature conducting member 108 secured to the bottom of the armature disc and having a contact 110 secured to the center thereof for engaging with contact 88 on plate 86. Armature 104 further comprises a non-magnetic element 112 from which projects a non-magnetic guide pin 114 which slidably fits within the aperture 102 of electromagnet 96. The armature conducting member 108 is electrically connected to post 48 by conductive straps 116 and 118, conducting member 108 and non-magnetic element 112 being attached to armature disc 106 by rivets 107. In a preferred embodiment of the invention the armature disc 106 is made of iron, the armature conducting member 108 is copper, the non-magnetic element 112 is made of brass as is the non-magnetic guide pin 114. The specific materials used for the element 112 and guide pin 114 are not critical provided that they are non-magnetic.

An insulating disc 120 is mounted on posts 48 and 54 and secured thereto by means of nuts 122 and 124. Mounted above insulating disc 120 is an insulating support 126 on which is mounted a full-wave rectifier 128 consisting of diodes 130, 132, 134 and 136. A filter capacitor 138 is connected across the output terminals 140 and 142 of the bridge in parallel with the coil 97 of electromagnet 96. The input terminal 144 of the bridge is connected to terminal 50 of photocell 12 by means of the post 54. The other input terminal 146 of the bridge is connected to prong 32 by post 48 and plate 46. Terminal 146 is also connected to armature disc contact 110 via post 48, straps 116, 118 and armature disc 106.

Figure 8:
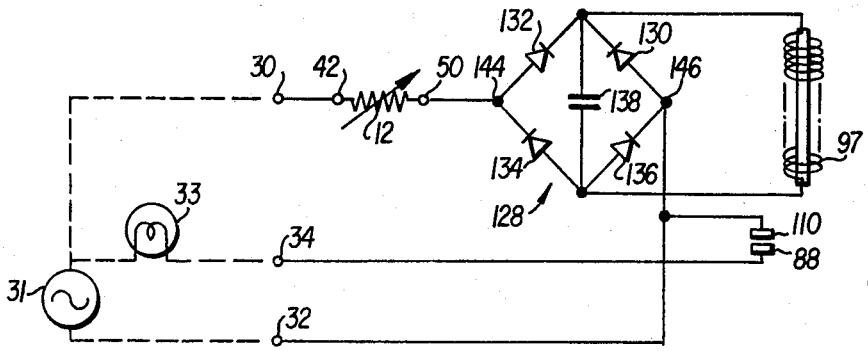
FIG. 8 is a schematic circuit diagram showing the electrical circuit of the present invention.
Figure 3:
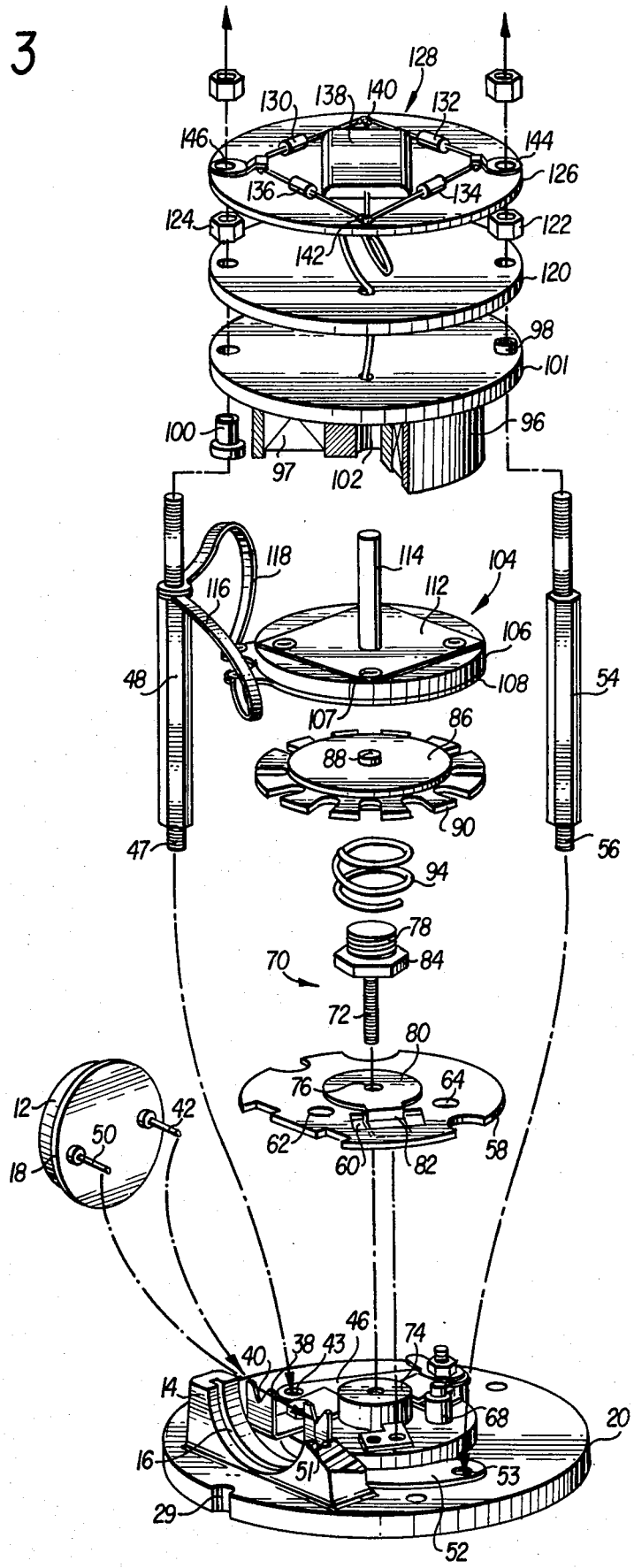
FIG. 3 is an exploded view of the device with the cover and plug-in prongs omitted.
Figure 4:
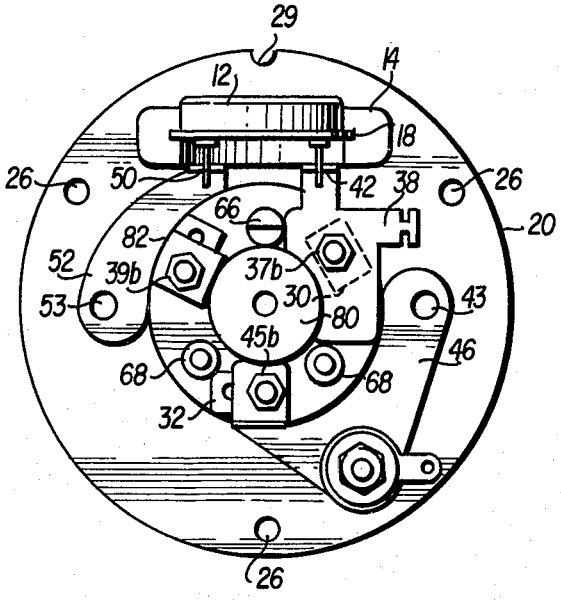
FIGS. 4 and 5 are top and bottom views of the base member and components mounted thereon.
Figure 5:
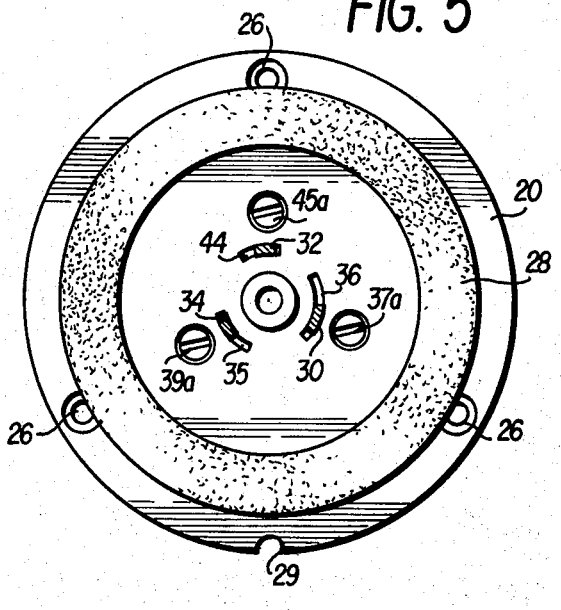
Figure 6:
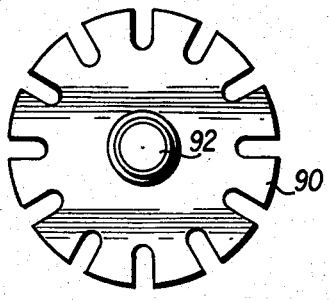
FIGS. 6 and 7 are bottom views of the contact plate and armature, respectively.
Figure 7:
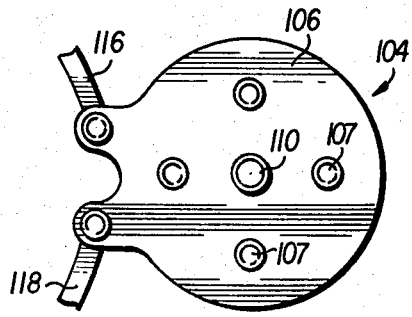

The operation of the light sensitive control switch is best understood in connection with the schematic diagram of FIG. 8. The numbers identifying the components of FIG. 7 correspond to those shown in FIGS. 2–6.

Assuming that light impinging on photocell 12 is less than a predetermined amount, for example one footcandle, the current flowing from external alternating voltage source 31 through prong 30, photocell 12, full-wave rectifier 128 and prong 32 would be too small to cause the electromagnet coil 97 to pick-up armature 104. Consequently, the armature would drop by gravity until its contact element 110 touches contact 88 on plate 86 thereby completing the circuit between alternating current source 31, lamp 33, prong 34 and prong 32. As the ambient light increases, as when daylight approaches, the resistance of photocell 12 decreases to a value which allows current to flow through the rectifier 128 thereby producing a voltage across capacitor 138 which is sufficient to allow a current to flow through the coil 97 and lift armature 104 vertically upward so that contacts 110 and 88 are separated thereby turning off lamp 33. Because the only forces acting on armature 104 are the force of gravity and the magnetic flux generated by the electromagnet, the armature is energized at precisely the desired level of light illumination and this operation can be reproduced over a long period of time.

This is in contrast with the operation obtained with the normal prior art relay wherein it is difficult to adjust the spring contacts and to maintain the gap between contacts over the life of the device.

The function of the non-magnetic plate 112 is to permit the armature 104 to be released by the electromagnet 96 when the light impinging on the photocell 12 increases above the predetermined level. Without the non-magnetic element 112, there would be a tendency for the armature to "hang up" so that the contacts 110 and 88 would not touch. This effect is substantially eliminated by providing the plate 112. Typically, the non-magnetic plate is 0.004 inch thick and the armature is a disc 3/16 inch thick and $1\frac{3}{4}$ inches in diameter.

The spacing between contacts 88 and 110 is adjusted at the factory for optimum operation by rotating the insulating adjusting ring 90 on the stud 70 until the desired gap is attained. This gap, which remains fixed because of the pressure of helical spring 94, must be great enough so that an arc cannot be established when the coil 97 is energized. However, it must not be too large because this would reduce the sensitivity of the control. I have found an optimum value to be 0.007 inch.

Tests were conducted on the light responsive control switch by exposing the photocell 12 to decreasing and increasing ambient illumination of approximately one footcandle. It was found that with housing 10 made of Lucite, employing an RCA cadmium sulphide photocell, a coil 87 having a resistance of 14,000 ohms and a 120 volt source, that the armature 104 was picked up and dropped out within a range of ±20% of the one footcandle value. That is, the lighting load was energized before the ambient light fell below 0.8 footcandle and was deenergized before it increased above 1.2 footcandles.

What is claimed is:

1. A light responsive control switch for controlling a load in response to a predetermined amount of light incident thereon, comprising:

a light sensitive element for receiving said incident light, an electromagnet having a longitudinal axis, said electromagnet including a coil coaxial with said longitudinal axis and electrically coupled to said light sensitive element, said electromagnet having an aperture therein extending along said longitudinal axis, an armature composed of a magnetic material positioned adjacent said electromagnet, said armature being translatable along said longitudinal axis upon energization of said electromagnet;

a non-magnetic guide pin secured to said armature, said guide pin extending into said aperture, contact means positioned adjacent said armature, said armature making electrical contact with said contact means when said electromagnet is deenergized, and means for coupling said contact means and said armature to said load.

2. A light responsive control means as defined by claim 1 wherein said electromagnet has an aperture therein extending along said longitudinal axis and wherein a non-magnetic guide pin is secured to said armature, said guide pin extending into the aperture in said electromagnet thereby guiding said armature as it is translated.

3. A light responsive control means as defined by claim 1 wherein a non-magnetic element is secured to the surface of said armature adjacent said electromagnet, said non-magnetic element assuring prompt release of said armature when said electromagnet is deenergized.

4. A light responsive control switch for controlling a load in response to a predetermined amount of light incident thereon, comprising a non-conducting support member, a photocell for receiving said incident light mounted on said support member, the electrical resistance of said photocell corresponding to the magnitude of said incident light, first, second and third terminals attached to said support member, said first terminal being connected to one end of said photocell, a conductive stud secured to said support member and electrically connected to said second terminal, a contact plate engaged with said stud for vertical movement with respect thereto, said contact plate having an electrical contact surface thereon, an electromagnet having a coil spaced from said support member, said electromagnet having an aperture therein coaxial with said coil and the axis of said stud, an armature disc composed of a magnetic material and having a non-magnetic element secured thereto with a guide pin projecting from one surface thereof, said armature disc being interposed between said contact plate and said electromagnet, the guide pin projecting from said armature disc slidably fitting within the aperture in said electromagnet, the other surface of said armature disc having a conducting member secured thereto for engaging the contact on said contact plate when said electromagnet is deenergized, a rectifier mounted adjacent said electromagnet and connected between the other end of said photocell and the coil of said electromagnet, and means coupling said rectifier and the conducting member of said armature disc to said third terminal.

5. A light responsive control means as defined by claim 4 wherein said conductive stud and contact plate are provided with engaging threads for rotatably translating said contact plate with respect to said stud thereby adjusting the distance between said contact plate and the conducting member on said armature disc when said electromagnet is energized, said control switch further comprising resilient means interposed between said support member and said contact plate to control rotation of said contact plate.

6. A light responsive control means as defined by claim 5 wherein said resilient means is a helical spring.

7. A light responsive control means as defined by claim 4 wherein said rectifier is a full-wave rectifier having its input terminals connected to the other end of said photoconductor cell and said third terminal, and its output terminals connected across the coil of said electromagnet.

* * * * *